United States Patent [19]

Rokosz

[11] 4,032,816

[45] June 28, 1977

[54] SAFETY SWITCH WHICH RENDERS HID LAMP INOPERATIVE ON ACCIDENTAL BREAKAGE OF OUTER ENVELOPE

[75] Inventor: Ferdinand Rokosz, Pompton Plains, N.J.

[73] Assignee: Westinghouse Electric Corporation, Pittsburgh, Pa.

[22] Filed: Jan. 16, 1976

[21] Appl. No.: 649,775

Related U.S. Application Data

[63] Continuation-in-part of Ser. No. 609,138, Aug. 29, 1975, abandoned.

[52] U.S. Cl. ..... 315/73; 313/17; 313/227; 315/74; 315/106; 315/107

[51] Int. Cl.[2] ..... H01J 7/44; H01J 13/46; H01J 17/34; H01K 1/62

[58] Field of Search ..... 315/73, 74, 75, 47, 315/60, 119, 125, 106, 107; 313/17, 227

[56] References Cited

UNITED STATES PATENTS

| | | | |
|---|---|---|---|
| 2,113,314 | 4/1938 | Brueckmann | 315/47 |
| 2,286,789 | 6/1942 | Dench | 315/47 |
| 2,950,417 | 8/1960 | Breeding et al. | 315/75 |
| 3,767,965 | 10/1973 | Collins et al. | 315/75 |
| 3,872,340 | 3/1975 | Collins | 315/75 |
| 3,965,387 | 6/1976 | Stuart et al. | 315/73 |

FOREIGN PATENTS OR APPLICATIONS

| | | | |
|---|---|---|---|
| 687,096 | 9/1953 | United Kingdom | 315/119 |
| 267,753 | 4/1970 | U.S.S.R. | 315/74 |

*Primary Examiner*—Saxfield Chatmon, Jr.
*Attorney, Agent, or Firm*—W. D. Palmer

[57] ABSTRACT

HID lamp has a spring-loaded safety switch positioned between the outer protective envelope and the arc tube and electrically connected in series with one of the lamp electrodes. When the lamp is operating normally, the safety switch is maintained in the closed position, but if the outer envelope is accidentally broken, the switch automatically opens to break the lamp energizing circuit and render the lamp inoperative.

7 Claims, 5 Drawing Figures

SAFETY SWITCH WHICH RENDERS HID LAMP INOPERATIVE ON ACCIDENTAL BREAKAGE OF OUTER ENVELOPE

CROSS-REFERENCE TO RELATED APPLICATIONS

This application is a continuation-in-part of copending application Ser. No. 609,138, filed Aug. 29, 1975, and owned by the present assignee.

In copending application Ser. No. 607,411, filed Aug. 25, 1975, and owned by the present assignee, is disclosed an HID lamp which has an oxidizable link positioned between the outer protective envelope and the arc tube and electrically connected in series with one of the lamp electrodes. Under normal lamp operating conditions, the link is heated to an incandescent condition and if the outer envelope is accidentally broken, the link immediately oxidizes and breaks to open the arc tube energizing circuit and render the lamp inoperative.

BACKGROUND OF THE INVENTION

It has been reported that high-intensity discharge (HID) lamps, such as high-pressure mercury-vapor lamps, can constitute a safety hazard if the outer envelope is broken and the lamp continues to operate, because of the generation of short wavelength ultraviolet radiations which are passed by the quartz arc tube. Lamps which are protected by a fuse are generally known in the art and a projection lamp which is fused in order to prevent dangerous arcing currents is described in U.S. Pat. No. 2,859,381, dated Nov. 4, 1958.

High-intensity discharge lamps have also been operated with a tungsten filament included between the arc tube and the outer envelope for purposes of ballasting the discharge and also generating some visible light. While the purpose of the ballasting and light-generating filament is not that of a link or safety switch, such a filament will normally oxidize and fail, particularly under lamp start-up conditions, if the outer envelope is broken, since this permits the filament to come in contact with air. Of course, such a supplemental ballasting filament consumes an appreciable portion of the total power consumed by the lamp, which decreases the lamp operating efficiency.

SUMMARY OF THE INVENTION

The basic HID lamp comprises an elongated radiation-transmitting arc tube which is enclosed by and supported within a light-transmitting protective envelope which is opaque to short wavelength ultraviolet raditions. The arc tube conventionally encloses a discharge-sustaining filling and has electrodes operatively positioned therein proximate the end thereof. Electrical lead-in means are sealed through the arc tube and connect to the lamp electrdes and an electrical adaptor means, such as a conventional screw-type base, is affixed to the outer surface of the protective envelope. The electrical adaptor means and the electrical lead-in means are connected to one another by electrical conductor means. In accordance with the present invention, a portion of the electrical conductor means, which connects the base and a lead-in, includes in series circuit arrangement as a part thereof a make-and-break switch. The switch includes a mechanically actuated contact member having an open position in which the switch is electrically nonconductive and the contact member also has a closed position in which the switch is electrically conductive. A spring urges the contact member toward the open position and the contact member is movable to the closed position against the resilient force of the spring. A positioning means within the envelope maintains the switch in predetermined position with the mechanical contact member of the positioned switch maintained in the closed position by being pressed against the inner surface of the protective envelope. With such an arrangement, accidental breakage of the protective envelope will permit the contact member to move to the open position under the resilient force of the spring, which renders the lamp inoperative.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
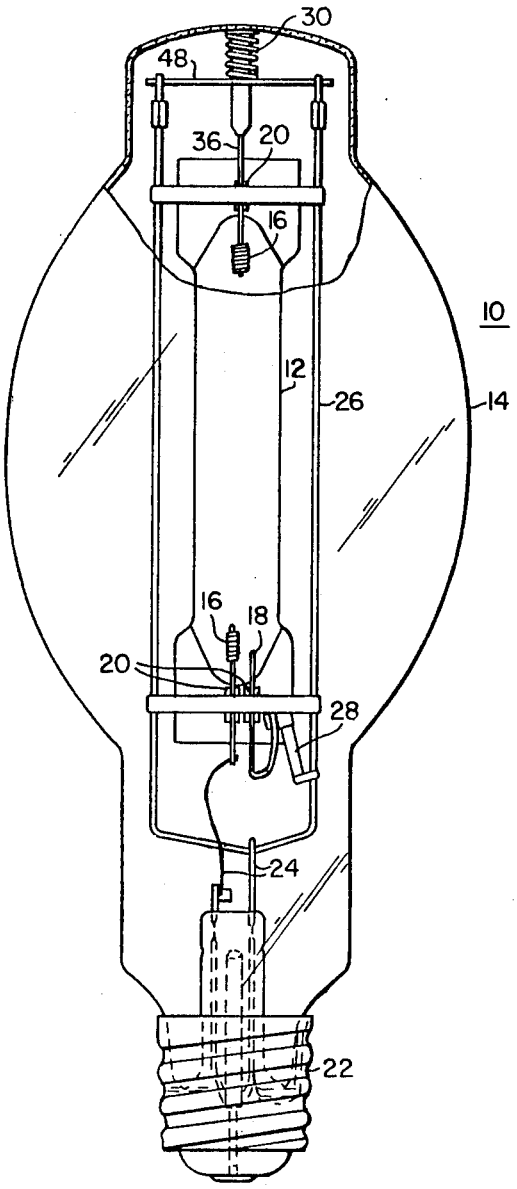
FIG. 1 is an elevational view, partly broken away, showing a high-intensity discharge lamp which incorporates a built-in switch in accordance with the present invention.

In FIG. 1 is shown a high-intensity discharge lamp which in this embodiment is a high-pressure, mercury-vapor discharge lamp 10. The lamp comprises an elongated radiation-transmitting arc tube 12 which is enclosed by and supported within a light-transmitting protective envelope 14 which is opaque to the short wavelength ultraviolet radiations which are generated within the arc tube during lamp operation. Since the arc tubes are usually made of ultraviolet-transmitting material such as quartz, these generated radiations readily pass through the envelope of the arc tube 12. The arc tube has electrodes 16 operatively positioned proximate the ends thereof and a conventional starting electrode 18 is operatively positioned proximate one of the operating electrodes 16. Electrical lead-in means such as ribbon conductors 20 are sealed through the arc tube and connect to the electrodes 16, 18.

An electrical adaptor, such as a conventional screw-type base 22, is affixed to the outer surface of the protective envelope 14 to facilitate the electrical connection for the lamp to a source of electrical power, and electrical conductors 24 connect the screw-type base 22 to the ribbon conductors 20. In the embodiment as shown in FIG. 1, electrical connection is made to the uppermost operating electrode 16 through the arc tube supporting frame 26. A starting resistor 28 is connected between the supporting frame and the starting electrode 18. In operation of the lamp, when an energizing potential is applied to the screw-type base 22, an initial discharge takes place between the starting electrode 18 and the adjacent operating electrode 16, which ionizes the starting gas within the arc tube 12. When the gas is sufficiently ionized, the primary arc strikes between the operating electrodes 16.

Figure 2:
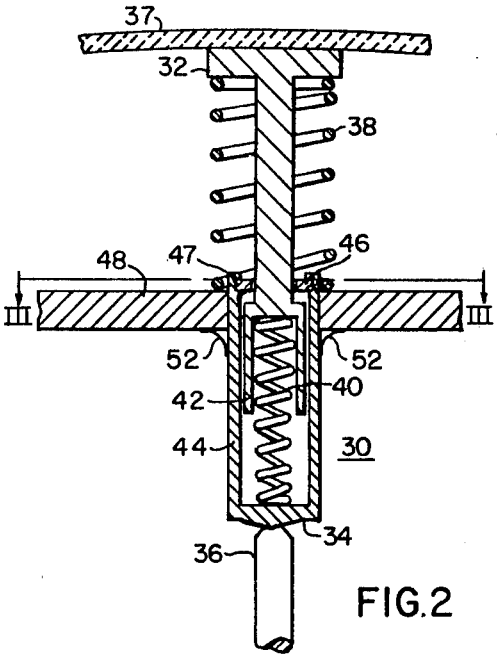
FIG. 2 is an enlarged sectional view showing the constructional details for the make-and-break switch.
Figure 3:
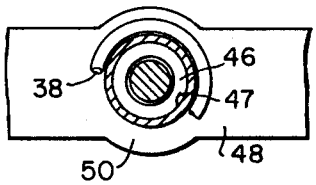
FIG. 3 is a fragmentary sectional view of the switch support structure taken on the line III—III in FIG. 2 in the direction of the arrows.

In accordance with the present invention, the upper portion of the arc tube supporting frame 26 is modified to accommodate a make-and-break switch 30 which is shown in more detail in FIGS. 2 and 3. Referring to FIG. 2, the switch 30 comprises a mechanically actuated contact member 32 which is shown in the closed position in order that a first electrical contact 34 is forced against a second contact 36, which in turn is electrically connected to the uppermost ribbon conductor 20 and upper electrode 16. If the contact member 32 were not held in position by the inner surface of the upper or dome portion 37 of the envelope 14, the switch 30 would be in the open position and there would be no electrical contact between the electrical contact 34 and the other contact 36. A spring 38 urges the mechanical contact member 32 toward the open position, but the switch is maintained in the closed position by the presence of the upper or dome portion 37 of the envelope 14 which is furthest removed from the base 22. During the lamp fabrication, the contact member 32 is moved to a closed position against the resilient force of the spring 38.

In the embodiment of the switch as shown, a second and stiffer spring 40 is provided in order to accommodate for lamp-to-lamp variations in dimensions so that electrical contact between the members 34 and 36 will always be assured when the switch 28 is closed. This is accomplished by forming the mechanical contact member 32 integral with a hollow plunger member 42 which slips within the hollow body portion 44 of the switch 30. The second and stiffer spring 40 compresses slightly to accommodate tolerance differences in the distance between the second electrical contact 36 and the inner surface of the upper or dome position of protective envelope 14. A retaining ring 46 fits into a receiving groove 47 in the inner surface of the upper portion of the switch body member 44, against which the plunger-like member 42 can abut to limit its motion within the hollow body member 44.

The upper cross support 48 of the arc tube supporting frame 24 is modified to accommodate the switch 30 and the switch body portion 44 slides within a switch receiving bushing member 50 which is retained within the top cross support 48 of the arc tube supporting frame 24. Additional resilient metal members 52 form a sliding electrical contact with the switch body portion 44, in order to insure electrical continuity at all times.

If the protective envelope 14 is accidentally broken, the mechanical contact member 32 is released and is forced upwardly by the spring 38. This in turn moves the contact 34 from the contact 36, thereby opening the electrical circuit and rendering the lamp inoperative. Such a make-and-break switch is very positive in operation and its action is simultaneous with any accidental shattering of the outer envelope 14.

While one embodiment of a spring-loaded make-and-break switch has been shown and described, the switch designs may take many different forms of spring-loaded switch devices which are actuated by shattering of the protective envelope 14.

While the lamp embodiment as shown in a high-pressure mercury-vapor lamp, the present safety switch could also be used in conjunction with any other type of high-intensity discharge lamp such as a high-pressure sodium-mercury lamp or a high-pressure mercury-metal halide lamp.

Figure 4:
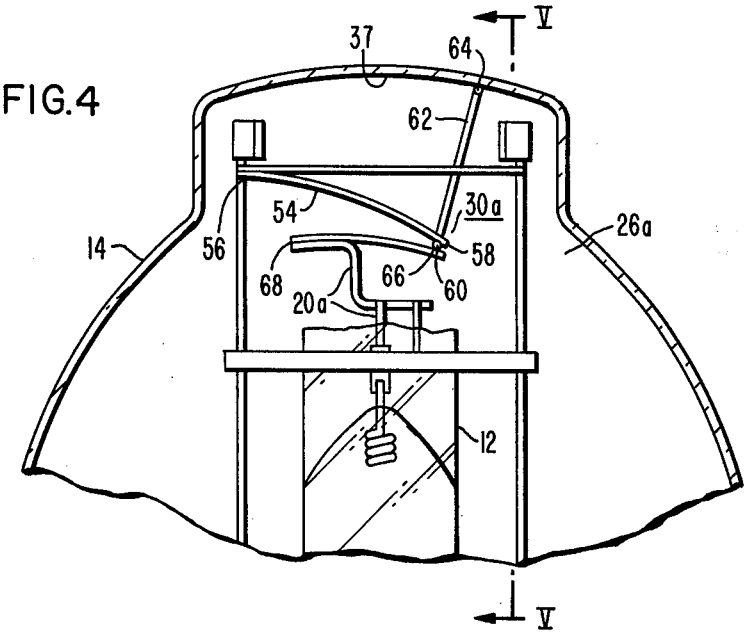
FIG. 4 is an enlarged, fragmentary view, shown partly in section, illustrating an alternative switch embodiment which is of very simple design.
Figure 5:
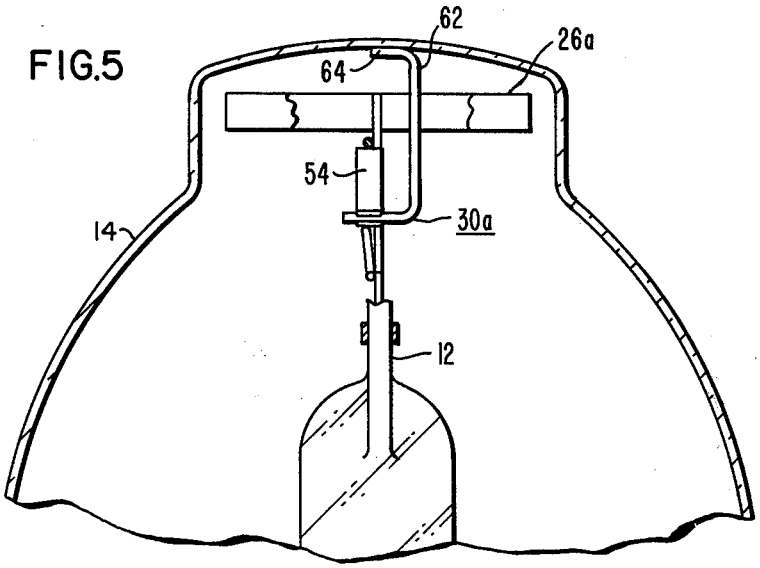
FIG. 5 is a sectional view taken on the line V—V in FIG. 4 in the direction of the arrows.

A simplified switch means **30*a* is shown in the enlarged views of FIGS. 4 and 5, wherein the arc tube frame 26*a* comprises a positioning means within the protective envelope 14 for maintaining both the switch 30*a* and the arc tube 12 in predetermined position within the protective envelope 14. The switch 30*a* comprises a resilient leaf spring body 54 having one end thereof rigidly affixed to the arc tube frame 26*a* with the other end thereof 58 being movable against the resiliency of the leaf spring body. The switch contact member 60 is affixed to the leaf spring body 54 proximate the movable end 58. A double-ended, rigid switch actuating member 62 has one end thereof affixed proximate the movable end 58 of the leaf spring body 54 and the other end 64 is urged by the resiliency of the leaf spring body 54 into contact with the inner dome surface 37 of the protective envelope 14. An arc tube electrical contact means 66, which preferably is a portion of a second leaf spring body, electrically connect to one of the current lead-ins 20*a* of the arc tube 12. The dimensions of the switch actuating member 62 normally causes the movable end 58 of the leaf spring body 54 to be urged against its resiliency and toward the arc tube 12 to force contact between the switch contact member 60 and the arc tube contact 66 to maintain the switch in the closed position. Any breakage of the protective outer envelope 14 permits the switch actuating member 62 to be moved away from the arc tube 12 by the resiliency of the leaf spring body 54 to break the electrical contact between the switch contact member 60 and the arc tube contact 66** in order to place the switch in the open, nonconducting position and render the lamp inoperative.

In its preferred form, the arc tube electrical contact 66 comprises a second leaf spring body, as indicated hereinbefore, and one end thereof 68 is rigidly affixed to one of the lead-in means **20*a* of the arc tube 12 with the other end thereof movable against the resiliency of the spring body. When the switch is in its normal closed position, the contact portion 60 contacts the second leaf spring body 66 proximate the movable end thereof with the electrical contact therebetween maintained by the resiliency of both the switch leaf spring body 54 and the second leaf spring body 66, in order to insure that electrical contact is always maintained when the switch is closed to accommodate for any tolerance differences which may exist from lamp to lamp. The leaf spring bodies 54 and 66** are preferably formed of heat resisting nickel alloy.

I claim:

1. In combination with a high-intensity discharge lamp comprising an elongated radiation-transmitting arc tube which is enclosed by and supported within a light-transmitting protective envelope which is opaque to short wavelength ultraviolet radiations, said arc tube enclosing a discharge-sustaining filling and having electrodes operatively positioned therein proximate the ends thereof, electrical lead-in means sealed through said arc tube and connected to said electrodes, electrical adaptor means affixed to the outer surface of said protective enevelope to facilitate electrical connection of said lamp to a source of electrical power, and electrical conductor means electrically connecting said electrical adaptor means to said electrical lead-in means, the improvement which comprises:

a. a make-and-break switch means included in series circuit arrangement with said electrical conductor means, said switch means including an electrical contact member having an open position in which said switch means is electrically nonconductive and said electrical contact member also having a closed position in which said switch means is electrically conductive, a spring urging said electrical contact member to the open position, and said electrical contact member being movable to the closed position against the resilient force of said spring;

b. positioning means within said protective envelope for maintaining said switch means in predetermined position within said protective enevelope, and a mechanical contact member of said positioned switch means pressing against the inner surface of said protective envelope to maintain said electrical contact member in said closed electrically conductive position against the resilient force of said spring; whereby breakage of said protective envelope will permit said electrical contact member to move to said open electrically nonconductive position under the resilient force of said spring to render said lamp inoperative.

2. The lamp as specified in claim 1, wherein said lamp is of the high-pressure, mercury-vapor discharge type.

3. The lamp as specified in claim 2, wherein said spring has the configuration of a leaf spring.

4. The lamp as specified in claim 1, wherein said mechanical contact member presses against the inner-surface portion of said protective envelope which is furthest removed from said electrical adaptor means.

5. In combination with a high-intensity discharge lamp comprising an elongated radiation-transmitting arc tube which is enclosed by and supported within a light-transmitting protective envelope which is opaque to short wavelength ultraviolet radiations, said arc tube enclosing a discharge-sustaining filling and having electrodes operatively positioned therein proximate the ends thereof, electrical lead-in means sealed through said arc tube and connected to said electrodes, electrical adaptor means affixed to the outer surface of said protective envelope to facilitate electrical connection of said lamp to a source of electrical power, and electrical conductor means electrically connecting said electrical adaptor means to said electrical lead-in means, the improvement which comprises:

a. a make-and-break switch means included in series circuit arrangement with said electrical conductor means as a part thereof, said switch means including a mechanically-actuated contact member having an open position in which said switch means is electrically nonconductive and said contact member also having a closed position in which said switch means is electrically conductive;

b. positioning means within said protective envelope for maintaining both said switch means and said arc tube in predetermined position within said protective envelope, said switch means comprising a resilient leaf spring body having one end thereof rigidly fixed to said positioning means with the other end thereof being movable against the resiliency of said lead spring body, said switch means contact member affixed to said leaf spring body proximate the movable end thereof, a double-ended rigid switch actuating member having one end thereof affixed proximate said movable end of said leaf spring body and the other end thereof urged by the resiliency of said leaf spring body into contact with the inner surface of said protective envelope, an arc tube electrical contact means electrically connected to a lead-in means of said arc tube, the dimensions of said switch actuating member normally causing the movable end of said leaf spring body to be urged against its resiliency toward said arc tube to cause said switch means contact member to electrically contact said arc tube electrical contact means to maintain said switch means in said closed position, and breakage of said protective envelope permitting said switch actuating member to be moved away from said arc tube by the resiliency of said leaf spring body to break the electrical contact between said switch means contact member and said arc tube contact means to place said switch means in said open position.

6. The lamp as specified in claim 5, wherein said arc tube electrical contact means comprises a second leaf spring body having one end thereof rigidly affixed to one of said lead-in means of said arc tube with the other end thereof movable against the resiliency of said second leaf spring body, and said switch means contact member in its normal position contacting said second leaf spring body proximate the movable end thereof with the contact therebetween maintained by the resiliency of both said switch means leaf spring body and the resiliency of said second leaf spring body to accommodate for tolerance differences.

7. The lamp as specified in claim 6, wherein said double-ended switch actuating member has one end thereof normally uged against the dome portion of said protective envelope.

* * * * *

Notice of Adverse Decision in Interference

In Interference No. 100,573, involving Patent No. 4,032,816, F. Rokosz, SAFETY SWITCH WHICH RENDERS HID LAMP INOPERATIVE ON ACCIDENTAL BREAKAGE OF OUTER ENVELOPE, final judgment adverse to the patentee was rendered Feb. 18, 1983, as to claims 1–4.

[*Official Gazette May 17, 1983.*]

REEXAMINATION CERTIFICATE (3rd)

United States Patent [19]

Rokosz

[11] B1 4,032,816

[45] Certificate Issued Apr. 13, 1982

[54] SAFETY SWITCH WHICH RENDERS HID LAMP INOPERATIVE ON ACCIDENTAL BREAKAGE OF OUTER ENVELOPE

[75] Inventor: Ferdinand Rokosz, Pompton Plains, N.J.

[73] Assignee: Westinghouse Electric Corporation, Pittsburgh, Pa.

Reexamination Request

No. 90/000,029, Jul. 16, 1981

Reexamination Certificate for:

| | |
|---|---|
| Patent No.: | **4,032,816** |
| Issued: | **Jun. 28, 1977** |
| Appl. No.: | **649,775** |
| Filed: | **Jan. 16, 1976** |

Related U.S. Application Data

[63] Continuation-in-part of Ser. No. 609,138, Aug. 29, 1975, abandoned.

[51] Int. Cl.[3]...H01J 7/44, H01J 13/46; H01J 17/34; H01K 1/62

[52] U.S. Cl....315/73; 313/17; 313/227; 315/74; 315/106; 315/107

[58] Field of Search...315/73, 74, 75, 47, 315/60, 119, 125, 106, 107; 313/17, 227

[56] References Cited

U.S. PATENT DOCUMENTS

| | | |
|---|---|---|
| 1,068,836 | 7/1913 | Banick. |
| 1,102,009 | 6/1914 | Czanyi. |
| 1,124,213 | 1/1915 | Czanyi. |

FOREIGN PATENT DOCUMENTS

| | | |
|---|---|---|
| 557,021 | 5/1957 | Belgium. |
| 1,943,486 | 8/1966 | Fed. Rep. of Germany. |
| 469,501 | 8/1914 | France. |

*Primary Examiner*—Saxfield Chatmon, Jr.

[57] ABSTRACT

HID lamp has a spring-loaded safety switch positioned between the outer protective envelope and the arc tube and electrically connected in series with one of the lamp electrodes. When the lamp is operating normally, the safety switch is maintained in the closed position, but if the outer envelope is accidentally broken, the switch automatically opens to break the lamp energizing circuit and render the lamp inoperative.

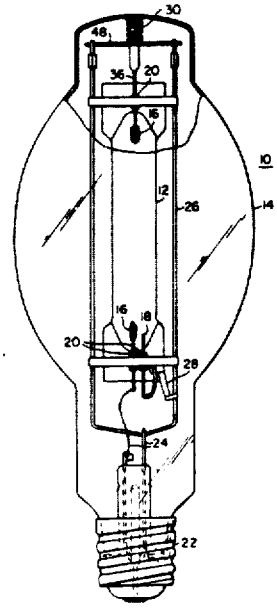

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *